US010126076B2

(12) United States Patent
Klein et al.

(10) Patent No.: US 10,126,076 B2
(45) Date of Patent: Nov. 13, 2018

(54) MAGAZINE COUPLING DEVICE

(71) Applicant: RJK Ventures LLC, Aliso Viejo, CA (US)

(72) Inventors: Ryan J. Klein, Aliso Viejo, CA (US); Paul B. Petitpierre, Aliso Viejo, CA (US)

(73) Assignee: RJK VENTURES LLC, Aliso Viejo, CA (US)

( * ) Notice: Subject to any disclaimer, the term of this patent is extended or adjusted under 35 U.S.C. 154(b) by 0 days.

(21) Appl. No.: 15/842,387

(22) Filed: Dec. 14, 2017

(65) Prior Publication Data

US 2018/0120042 A1 May 3, 2018

Related U.S. Application Data

(63) Continuation of application No. 14/966,310, filed on Dec. 11, 2015, now abandoned.

(60) Provisional application No. 62/199,001, filed on Jul. 30, 2015.

(51) Int. Cl.
*F41A 9/63* (2006.01)

(52) U.S. Cl.
CPC ..... *F41A 9/63* (2013.01)

(58) Field of Classification Search
CPC .... F41C 27/00; F41A 9/70; F41A 9/65; F41A 9/64; F41A 35/00; F41A 35/02; F41A 9/71; F41A 9/61; F41A 9/67; F41A 9/68; F41A 9/69; F41A 9/75; F41A 9/01; F41A 9/34; F41A 9/72
USPC ..... 42/49.01, 50, 90, 106, 49.02
See application file for complete search history.

(56) References Cited

U.S. PATENT DOCUMENTS 3,191,332 A * 6/1965 Ardolino ..... F41A 9/63 42/50
3,623,256 A * 11/1971 Shiplee ..... F41A 9/63 42/50
3,710,497 A * 1/1973 Musgrave ..... F41A 9/83 42/87
4,057,003 A * 11/1977 Atchisson ..... F41A 3/26 89/138
4,447,976 A * 5/1984 Cooper ..... F41A 9/63 42/18
4,484,403 A * 11/1984 Schwaller ..... B65D 21/0204 42/50
4,685,238 A * 8/1987 Schoepflin ..... F16B 5/0004 42/90

(Continued)

OTHER PUBLICATIONS

Office Action from USPTO dated May 18, 2017 for relating U.S. Appl. No. 14/966,310.

*Primary Examiner* — Troy Chambers
*Assistant Examiner* — Bridget A Cochran
(74) *Attorney, Agent, or Firm* — Klein, O'Neill & Singh, LLP

(57) ABSTRACT

A magazine coupling device includes two or more floor plate structures sharing a common base for connecting a plurality of magazines together to form a single connected unit. Each floor plate structure replaces a magazine floor plate secured to a bottom end of a detachable magazine. A release button receptacle extends through the base. A release button access channel extends from the release button receptacle to an outer surface of the base forming an access opening to allow access to the release button receptacle from outside the coupling device.

8 Claims, 12 Drawing Sheets

(56) References Cited

U.S. PATENT DOCUMENTS 4,939,979 A * 7/1990 Capawana ..... F41A 9/79 42/50
5,615,506 A * 4/1997 Jackson ..... F41A 9/63 42/50
6,481,136 B1 * 11/2002 Fitzpartick ..... F41A 9/65 42/18
6,722,253 B2 * 4/2004 Johnson ..... F41A 3/12 42/90
7,093,386 B1 * 8/2006 Vieweg ..... F41A 9/65 42/7
7,886,468 B1 * 2/2011 Pontollo, II ..... F41A 3/26 42/50
7,975,420 B2 * 7/2011 Pestana ..... F41A 9/68 224/931
D672,837 S * 12/2012 Wyatt ..... D22/108
8,578,919 B2 * 11/2013 Macy ..... F41A 9/68 124/45
8,607,489 B1 * 12/2013 Calvert ..... F41A 9/71 42/49.01
D706,895 S * 6/2014 Zayatz ..... D22/108
8,887,428 B1 * 11/2014 Lemoine ..... F41A 9/61 42/49.01
8,925,231 B2 * 1/2015 Lee ..... F41A 9/65 42/49.01
D735,831 S * 8/2015 Faifer ..... D22/108
9,097,480 B2 * 8/2015 Keng ..... F41A 9/65
9,255,749 B2 * 2/2016 Faifer ..... F41A 9/65
9,354,006 B2 5/2016 Purkiss
2012/0247310 A1 * 10/2012 Klasen ..... F41A 9/63 89/1.816
2014/0020275 A1 * 1/2014 Corso ..... F41A 9/70 42/49.01
2016/0003567 A1 * 1/2016 Purkiss ..... F41A 9/68 42/49.01
2016/0033220 A1 * 2/2016 Grandy ..... F41A 9/63 42/49.01

* cited by examiner

MAGAZINE COUPLING DEVICE

CROSS-REFERENCE TO RELATED APPLICATION

This application is a continuation application of co-pending application Ser. No. 14/966,310, filed on Dec. 11, 2015; which claims priority to provisional application Ser. No. 62/199,001, filed on Jul. 30, 2015, the entire contents of which are hereby incorporated by reference.

BACKGROUND

The present invention relates generally to firearm magazines. More particularly, the disclosure relates to coupling devices for coupling two or more detachable firearm magazines together.

Detachable magazines for handguns and long guns are designed to house a specific ammunition round or cartridge count, which is a function of the size of the magazine, the size of the cartridge, the size of the ammunition feeding device in the magazine, and sometimes the physical design of the firearm to which the magazine is detachably attached. In addition, the laws in some jurisdictions put strict limits on the cartridge capacity of magazines. Firearm users desiring access to ammunition beyond the capacity of an individual magazine need to carry additional individual magazines. Additional magazines are carried separately, often individually in waistband pouches designed to accommodate them. While devices exist that can connect or couple two magazines together, the existing devices do not provide a means to easily secure, in a semi-permanent way, two or more standard magazines using the features inherent to the magazine, nor do they allow for quick and secure access to additional magazines attached or in proximity to the magazine used by the firearm in this manner. Other existing magazine coupling devices require structural modifications to the individual magazines.

SUMMARY

The various embodiments of the present coupling device have several features, no single one of which is solely responsible for their desirable attributes. Without limiting the scope of the present embodiments as expressed by the claims that follow, their more prominent features now will be discussed briefly. After considering this discussion, and particularly after reading the section entitled "Detailed Description," one will understand how the features of the present embodiments provide the advantages described herein.

One aspect of a magazine coupling device in accordance with this disclosure allows multiple magazines to form a locked unit with separation capability, while maintaining the integrity and functionality of each individual magazine, and without the need for any structural modifications of the individual magazines.

Embodiments of the present coupling device for connecting a plurality of magazines together to form a single connected unit include a plurality of floor plate structures sharing a common base, a button release hole extending from each floor plate structure into the base, and a release channel extending from each of the button release holes to an outer surface of the base forming an access opening to allow access to the button release hole from outside the coupling device.

Each floor plate structure may be configured to receive and secure a bottom end of a detachable magazine, and may each include a pair of main sidewalls extending from opposite sides of the base, one or more nubs extending inwardly from an edge of each of the main sidewalls, and one or more grooves cooperatively defined by the one or more nubs, the main sidewalls, and a surface of the base. A back wall may join the main sidewalls for each floor plate structure. The plurality of floor plate structures may be integrally formed or attached together to form a single connected unit. The button release hole may be dimensioned to receive a release button of a magazine insert inside a chamber of a detachable magazine. The fit between the button release hole and the button may be close to minimize movement of the coupler transverse to the magazine. Each floor plate structure may be oriented in the same direction or in a different direction. An additional button release hole may be provided, along with an additional release channel extending from the additional button release hole to the outer surface of the base. Cavities may be defined in a surface of the base to reduce weight and friction with the magazine. The floor plate structures and the base may be made of standard polymers that are heat and chemical resistant.

Embodiments of the present magazine coupler for connecting magazines together to form a single connected unit include a plurality of floor plate structures, each floor plate structure being configured to engage a detachable magazine, a button release hole configured to receive a button to minimize movement of the coupler in a direction transverse to the bottom end, and a release channel extending from the button release hole to outside the coupler. The floor plate structures may be connected together back-to-back, and each floor plate structure may be configured to engage a bottom end of a corresponding detachable magazine. A tongue and groove joint may be formed between at least one of the floor plate structures and at least one of the detachable magazines. Each floor plate structure may include a pair of main sidewalls extending from opposite sides of a base, one or more nubs extending from an edge of each of the main sidewalls, and one or more grooves cooperatively defined by the one or more nubs, the main sidewalls, and a surface of the base. Each floor plate structure may be oriented in a different direction.

These and other aspects and embodiments will become apparent to those skilled in the art from the following detailed description of the various embodiments having reference to the attached figures, the disclosure not being limited to any particular embodiment.

BRIEF DESCRIPTION OF THE DRAWINGS

The various embodiments of the present coupling device for magazines now will be discussed in detail with an emphasis on highlighting the advantageous features. These embodiments depict the novel and non-obvious coupling device for multiple magazines shown in the accompanying drawings, which are for illustrative purposes only. These drawings include the following figures, in which like numerals indicate like parts.

DETAILED DESCRIPTION

Figure 1A:
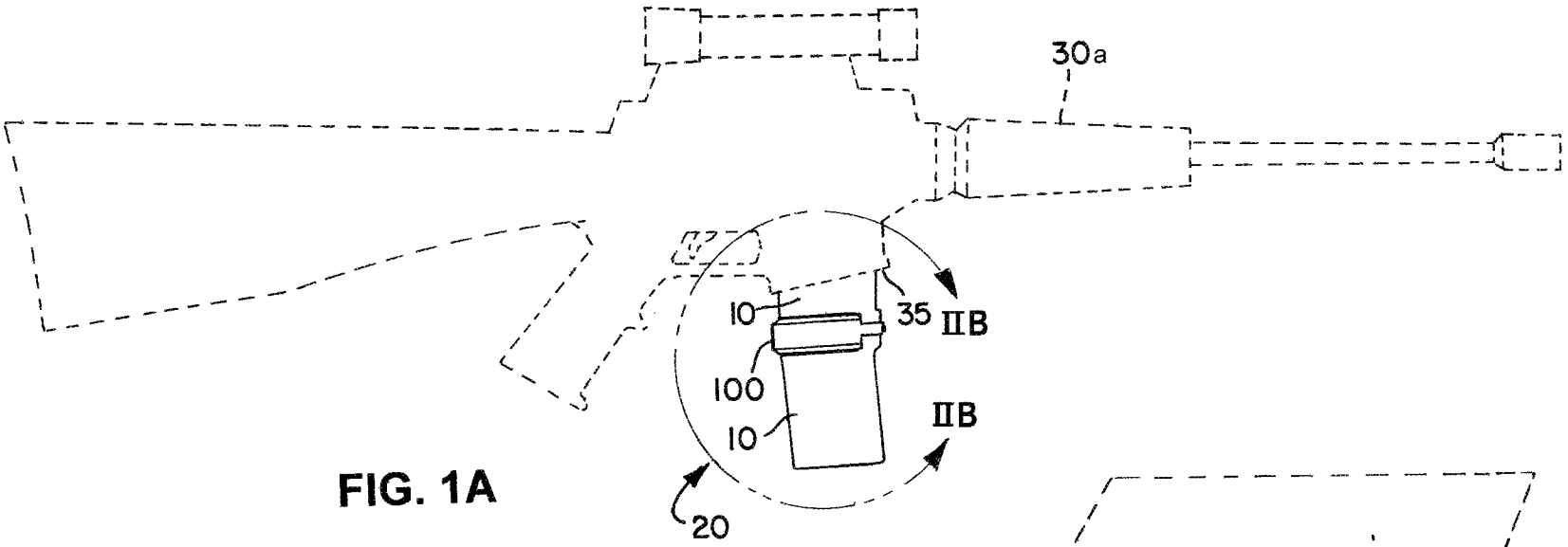
FIG. 1A is a side view of one embodiment of the present coupling device for connecting a plurality of magazines combined with a pair of magazines to form a single connected unit, shown with the connected unit installed in one type of firearm.

The following detailed description describes the present embodiments with reference to the drawings. In the drawings, reference numbers label elements of the present embodiments. These reference numbers are reproduced below in connection with the discussion of the corresponding drawing features.

The embodiments of the present coupling device for magazines are described below with reference to the figures. These figures, and their written descriptions, indicate that certain components of the apparatus are formed integrally, and certain other components are formed as separate pieces. Those of ordinary skill in the art will appreciate that components shown and described herein as being formed integrally may in alternative embodiments be formed as separate pieces. Those of ordinary skill in the art will further appreciate that components shown and described herein as being formed as separate pieces may in alternative embodiments be formed integrally. Further, as used herein the term integral describes a single unitary piece.

As described below, the present embodiments, which for simplicity will be referred to as a "coupling device" or "coupler," include devices for coupling two or more magazines together in a back to back, angled, or star pattern arrangement. The coupler connects the magazines together to form a single connected unit having a unique pattern and style.

Embodiments of the present coupler are designed to accommodate a variety of firearm types and sizes. The present embodiments are particularly well suited for accommodating auto-loading rifles, carbines, and handguns, but alternative embodiments may be suited for accommodating other types of firearms, such as certain types of shotguns, bolt-action rifles, and automatic pistols, rifles, and carbines. The coupler has unique design elements and attributes, described below, which provide secure attachment using existing magazine components, while also providing quick release capability, accessibility, and usability, such as with existing pouches and accessories for larger magazines.

The present embodiments leverage existing magazine components by using the pressure button of the magazine insert, and tongues and grooves provided at a base or bottom end of a standard magazine for a removable floor plate to secure the magazine to the coupler. Each magazine maintains its own ammunition, separate and apart from the ammunition in the other magazine(s) couple to it.

The present embodiments provide a pressure button release hole for receiving the pressure button and a release channel for access to the pressure button of the magazine insert to detach the magazine from the coupler.

The present embodiments provide quick and secure access of one or more additional magazines in direct semi-permanent attached proximity to the magazine used within the firearm.

The present embodiments allow for magazines to be securely connected together and accessible to the user without modification of the magazines. Furthermore, each individual magazine retains only its original cartridge count, as manufactured.

Figure 1B:
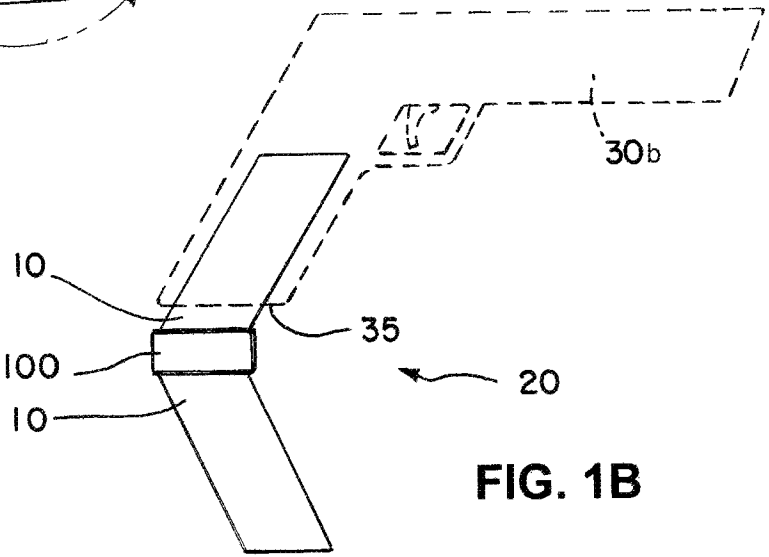
FIG. 1B is a side view of another embodiment of the connected unit, shown in another type of firearm.

With reference to FIGS. 1A and 1B, the present embodiments generically comprise a coupling device or coupler 100 configured to connect two or more magazines 10 "back-to-back" (or, more properly, bottom-to-bottom) to form a single connected unit 20. The connected unit 20 can be loaded into a magazine port 35 in the receiver of a rifle 30*a* (FIG. 1A), or in the grip of a pistol 30*b* (FIG. 1B). As will be explained below, the coupler 100 allows one of the magazines 10 to be loaded into the firearm for use, with the other magazine 10 coupled to it. When the first magazine 10 is empty, the coupled unit 20 is removed, turned around to present the second magazine 10 to the firearm, and the second magazine 10 is then loaded into the firearm. This feature not only allows the effective doubling of the firearm's magazine capacity without enlarging the capacity of the individual magazines 10, it also reduces the circumstances in which it is necessary to drop an empty magazine 10 to the ground or floor, thereby decreasing the probability of lost or damaged magazines 10.

In the illustrated embodiments, the coupler 100 couples a pair of magazines 10 together in a back to back (or bottom-to-bottom) arrangement. In other embodiments, the coupler 100 can connect the two or more magazines 10 in any pattern to allow for multiple secure and locking connections, such as an angled or star pattern. In one example, the coupler 100 can be shaped and designed to couple the pair of magazines 10 to form a connected unit 20 resembling a higher capacity magazine that can be used with existing pouches and bags fitted for higher capacity magazines. Although the connected unit 20 may look and feel like a higher capacity magazine, the coupler 100 maintains the utility, functionality, and round count of each discrete magazine 10. The coupler 100 is not limited to any particular magazine and can accommodate a variety of magazine types and sizes. In one example, the coupler 100 can combine a standard capacity magazine with a high capacity magazine, or combine the high capacity magazines together. The coupler 100 can be made of standard polymers used in the firearm industry that are heat and chemical resistant, and it can be made to match the color of the magazine 10.

Figure 2A:
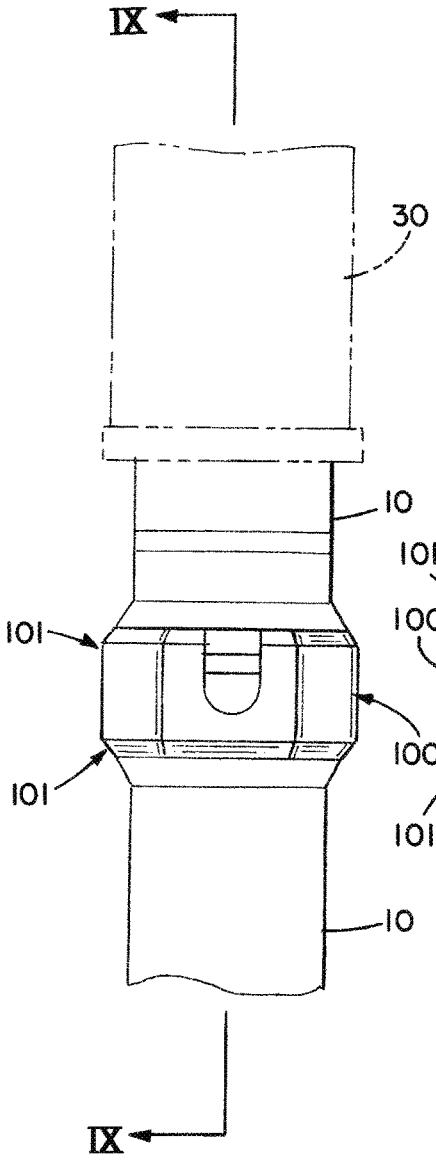
FIG. 2A is a partial rear view of the circled portion IIB-IIB in FIG. 1A.
Figure 2B:
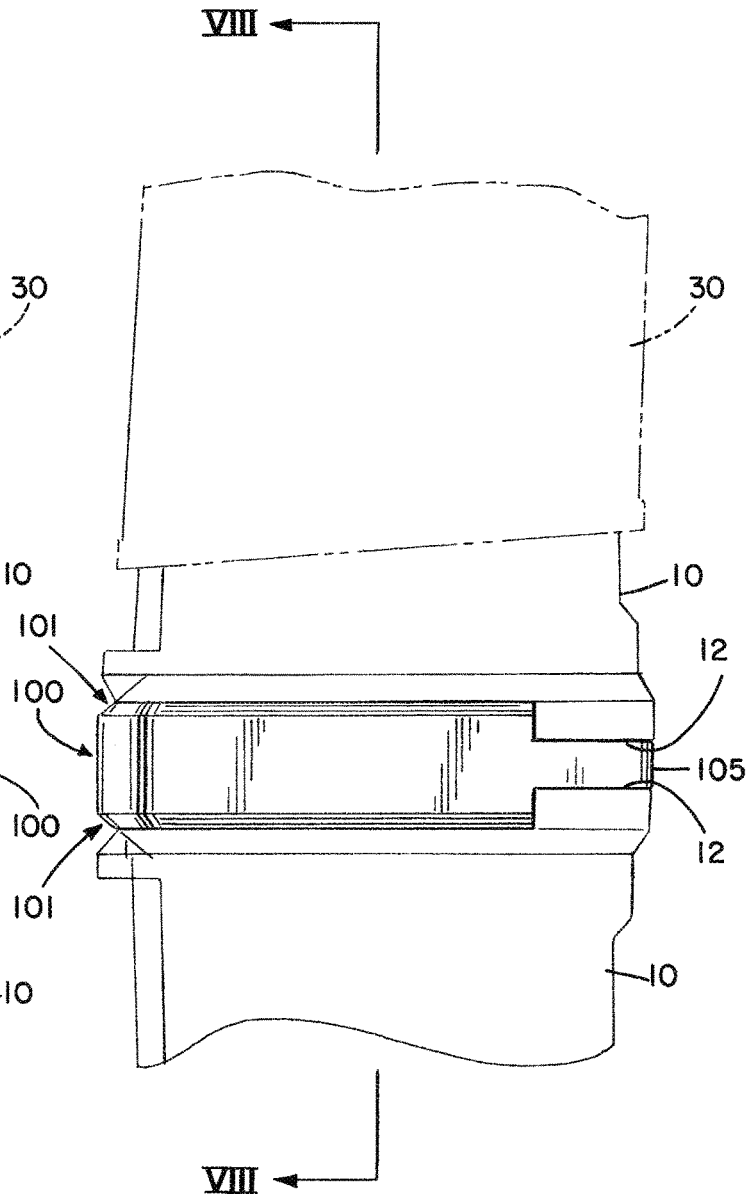
FIG. 2B is a partial side view of the circled portion IIB-IIB in FIG. 1A.

Referring now to FIGS. 2A and 2B, a standard magazine can have a magazine floor plate (not shown) attached to a bottom end 12 of the magazine 10. The magazine floor plate can be removed to clean a chamber 19 (FIG. 5) inside the magazine 10 or access components inside the chamber 19. The coupler 100 can be configured for replacing the magazine floor plate of each magazine 10 by engaging the bottom end 12 of each magazine 10, thereby coupling the magazines 10 together to form a single connected unit 20.

The coupler 100 comprises a pair of floor plate structures 101 (FIG. 3) on opposite sides of a common base or hub 105. In the illustrated embodiments, the floor plate structures 101 are integrally formed with the common base 105. In some embodiments, the floor plate structures 101 are assembled together to form the coupler 100. Each floor plate structure 101 is configured to engage the bottom end 12 of a magazine 10 and form a tight joint. The type of joint formed between the floor plate structure 101 and the magazine 10 can vary. In one embodiment, the bottom end 12 can have a pair of tongues running along opposite edges engaging with grooves in the floor plate structure 101 to form a strong tongue-and-groove joint when the coupler 100 is fully engaged with the magazine 10. In some embodiments, each floor plate structure 101 has attachment features similar to a magazine floor plate of a magazine 10 that is to be secured to the corresponding floor plate structure 101. Thus, the coupler 100 can be designed to accommodate a variety of magazines. In the illustrated embodiments, the floor plate structures 101 are arranged in a back-to-back arrangement so that the bottom ends 12 of the two magazines 10 are detachably coupled together. In this configuration, the ammunition rounds (not shown) are expelled from the magazine chamber 19 through an open top end opposite the bottom end 12 of each magazine 10.

Figure 3:
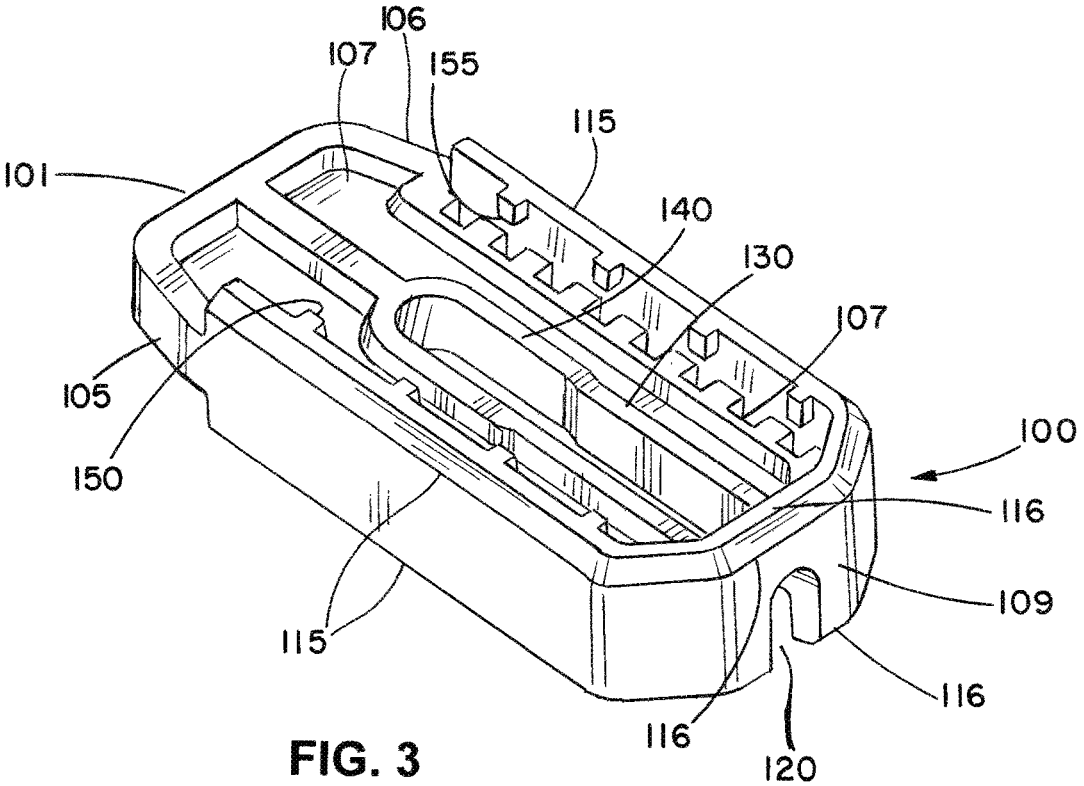
FIG. 3 is a bottom perspective view of one embodiment of the coupling device.
Figure 4:
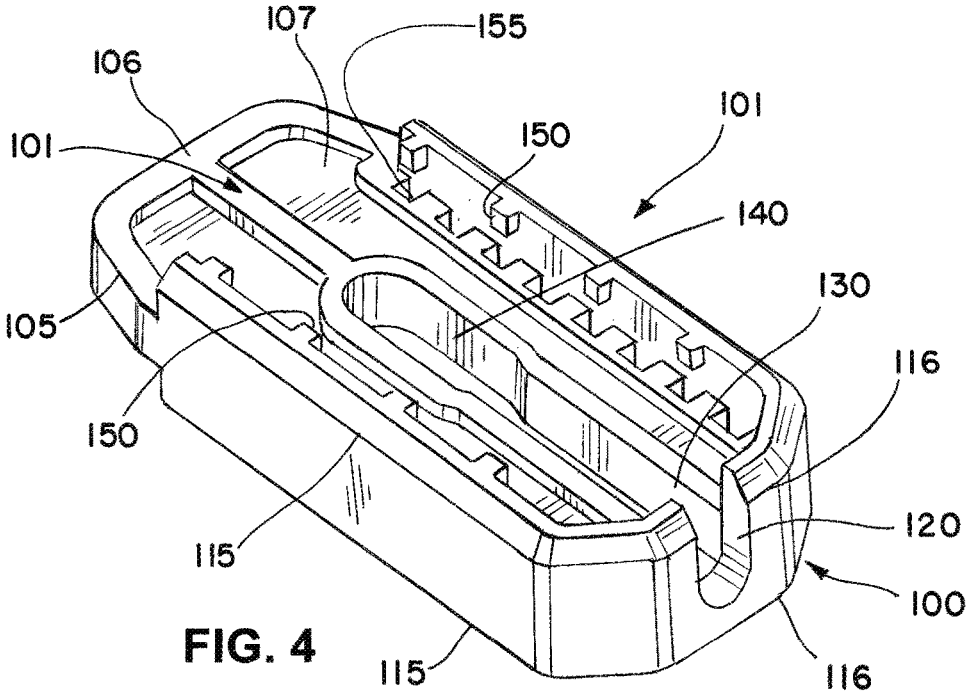
FIG. 4 is a top perspective view of the coupling device of FIG. 3.

As shown in FIGS. 3 and 4, the coupler 100 in accordance with an embodiment of the present disclosure includes two floor plate structures 101 on opposite sides of a common base or hub 105. In some embodiments, the coupler 100 comprises more than two floor plate structures 101 sharing a common base 105. In the illustrated embodiment, the base 105 is a substantially oblong plate with tapered and rounded corners. The base 105 can be any suitable shape, depending on the magazines 10 coupled by the coupler 100 and the desired appearance of the connected unit 20.

In the illustrated embodiment, the base or hub 105 has upper and lower main surfaces 107, each of which is bounded by a peripheral rim 106, whereby the upper and lower main surfaces 107 are recessed relative to the peripheral rim 106. A main sidewall 115 extends along each side of the hub or base 105, laterally spaced from, and extending vertically beyond, the adjacent portion of the peripheral rim 106. The main side walls 115 are joined by a back wall 116, whereby the main side walls 115 and the back wall 116 extend vertically beyond the upper and lower main surfaces 107. One or more nubs 150 extend inwardly from the top and bottom edges of each main sidewall 115 to form a U-shaped groove 155 on each side of the hub or base 105, configured to receive and engage with the bottom 12 of a magazine 10. More specifically, each groove 155 can be cooperatively defined by the corresponding nubs 150, the main sidewalls 115, the back wall 116, and the adjacent portion of the rim 106. In the illustrated embodiment, there are four nubs 150 on each main sidewall 115 for each floor plate structure 101 to define the U-shaped groove 155 on each side of the base or hub 105, each of the grooves 155 being configured to receive and secure the mating features of the magazine 10 as the bottom end 12 slides along the hub rim 106, as further discussed below. The number of nubs 150 may be varied, or they may be replaced by a continuous or interrupted lip extending inwardly from the edges of the side walls 115 and the back wall 116.

In an alternative embodiment (not shown), the peripheral rims 106 may be omitted thereby creating upper and lower surfaces 107 that are flat (i.e., not recessed). By recessing the upper and lower surfaces relative to a peripheral rim 106, however, both the weight of the coupler 100 and the friction experienced when sliding the bottom magazine end 12 into the groove 155 of the coupler 100 may be reduced. Furthermore, the floor plate structures 101 on opposite sides of the hub or base 105 can be individually configured to accommodate magazines 10 having bottom ends of different configurations.

A release button receptacle 140 configured to engage and secure a release button 42 (FIG. 5) extends through both floor plate structures 101 and the base or hub 105. A release button access channel 130 extends through the base 105 from the release button receptacle 140 to a back end 109 of the base 105, thereby forming an access opening 120 at the back end 109 of the base 105. The release button access channel 130 has a smaller size than the release button receptacle 140 to ensure the release button 42 is secured inside the release button receptacle 140. The access opening 120 and the release button access channel 130 can extend into the back wall 116 of one or both floor plate structures 110. In the illustrated embodiment, the access opening 120 is U-shaped, but it can be any desired shape such as circular. The access opening 120 allows a tool (such as a screwdriver, not shown) to be inserted through the release button access channel 130 into the release button receptacle 140 to engage the release button 42 when detaching the magazine 10 from the coupler 100, as discussed further below.

Figure 5:
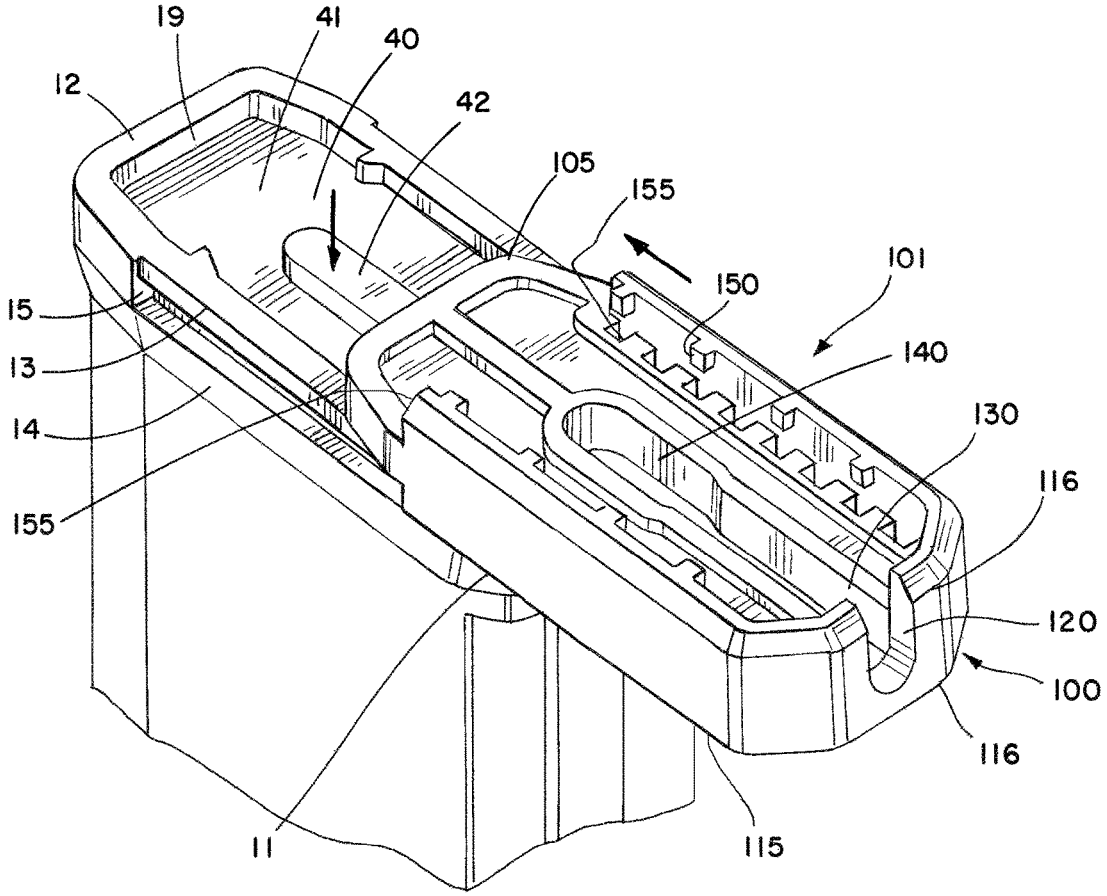
FIG. 5 is a top perspective view of the coupling device partially assembled to a first magazine.
Figure 6:
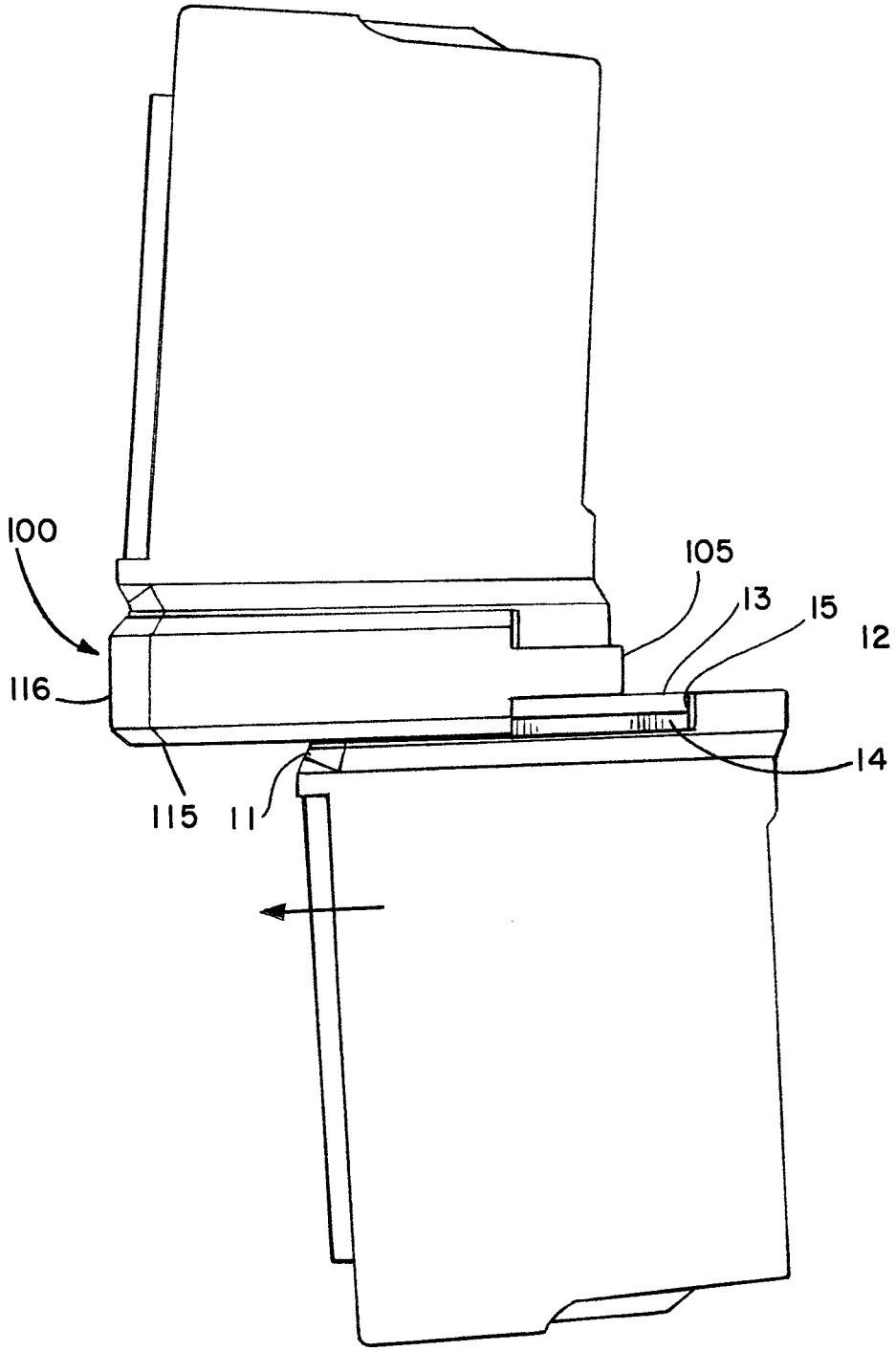
FIG. 6 is a side view of the coupling device assembled to the first magazine and partially assembled to a second magazine.
Figure 7:
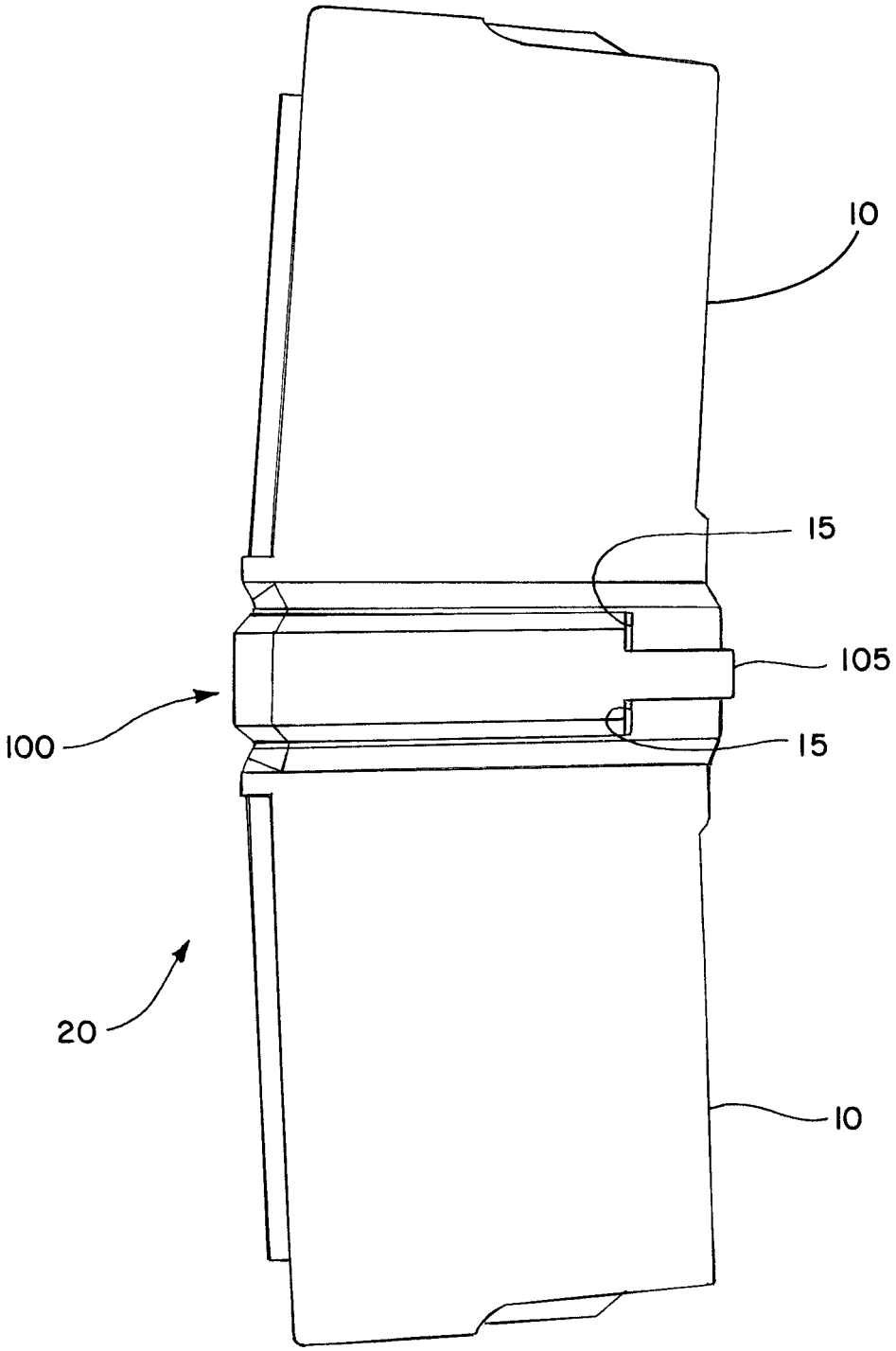
FIG. 7 is a side view of the coupling device assembled to both the first and second magazines.

FIGS. 5-7 illustrate various stages of assembling a pair of magazines 10 with the coupler 100 to form a connected unit 20 in accordance with an embodiment of the disclosure. Each magazine 10 contains a magazine insert 40 and a compression spring 47 (FIG. 8) inside the magazine chamber 19 of the magazine 10. The insert 40 has an insert base 41 and a release button 42 extending from the insert base 41 towards the bottom end 12. The spring 47 is configured for biasing the insert 40 towards the bottom end 12. The release button 42 is configured for engaging in the above-described release button receptacle 140 of the floor plate structure 101.

With reference to FIG. 5, the coupler 100 is secured to a first magazine 10 by guiding and sliding a front end of the coupler 100 transversely along the bottom end 12 of the magazine 10. A pair of tongues 13 extending transversely from the bottom end 12 engage with the U-shaped groove 155 of a first of the floor plate structures 101. The pair of tongues 13 can be formed by a pair of channels 14 defined on opposite sides of the magazine 10 adjacent the bottom end 12. The channels 14 extend from a front end 11 of the magazine toward stops 15 near a back end of the magazine 10. The channels 14 may also extend around the front end 11 of the magazine 10, thereby forming a continuous channel from one stop 15 to the other stop 15. The tongue 13 and groove 155 connection prevents the coupler 100 from being pulled normal to the bottom end 12 and secures the bottom end 12 against the hub or base 105. The fit between the tongues 13 and the groove 155 is advantageously a tight, interference fit to maintain a secure and snug fit and help prevent the coupler 100 from readily sliding off the first magazine 10.

Simultaneously, as the coupler 100 slides over the bottom end 12 of the first magazine 10, the insert 40 presses against the coupler 100 by the force of the spring 47. The tongues 13 of the first magazine 10 can slide inside the groove 155 until the back wall 116 abuts against the magazine 10, or the main sidewalls 115 abut against the stops 15. At this juncture, the release button 42 can now slide into the release button receptacle 140 under the force of the spring 47 to prevent the coupler 100 from moving transverse to the bottom end 12, thus securing and locking the coupler 100 to the first magazine 10. The release button 42 may be larger than the release button access channel 130 so that the release button 452 engages the release button receptacle 140 and not the release button access channel 130, thereby limiting transverse movement of the magazine 10 according to the fit between the release button 42 and the release button receptacle 140. The fit between the release button 42 and the release button receptacle 140 can be a close fit to limit any sliding movement of the coupler 100 with respect to the magazine 10. If necessary, the release button 42 can be pressed into the release button receptacle 140.

Referring now to FIG. 6, the tongues 13 of the second magazine 10 are slid into the groove 155 of the second of the floor plate structures 101 until the release button 42 of the second magazine 10 engages the release button receptacle 140 to secure the second magazine to the coupler 100, thereby forming the connected unit 20 as shown in FIG. 7. The connected unit 20 maintains the round count of each individual magazine 10 and utilizes existing components inside the magazine 10 to secure the magazines 10 together via the coupler 100.

The connected unit 20 can be loaded into the firearm with the first magazine 10 of the connected unit 20 inserted into the magazine port 35. After the ammunition from the first magazine 10 has been discharged, the connected unit 20 can be removed and flipped around so that the second magazine 10 of the connected unit 20 can be inserted into the magazine port 35.

Figure 8:
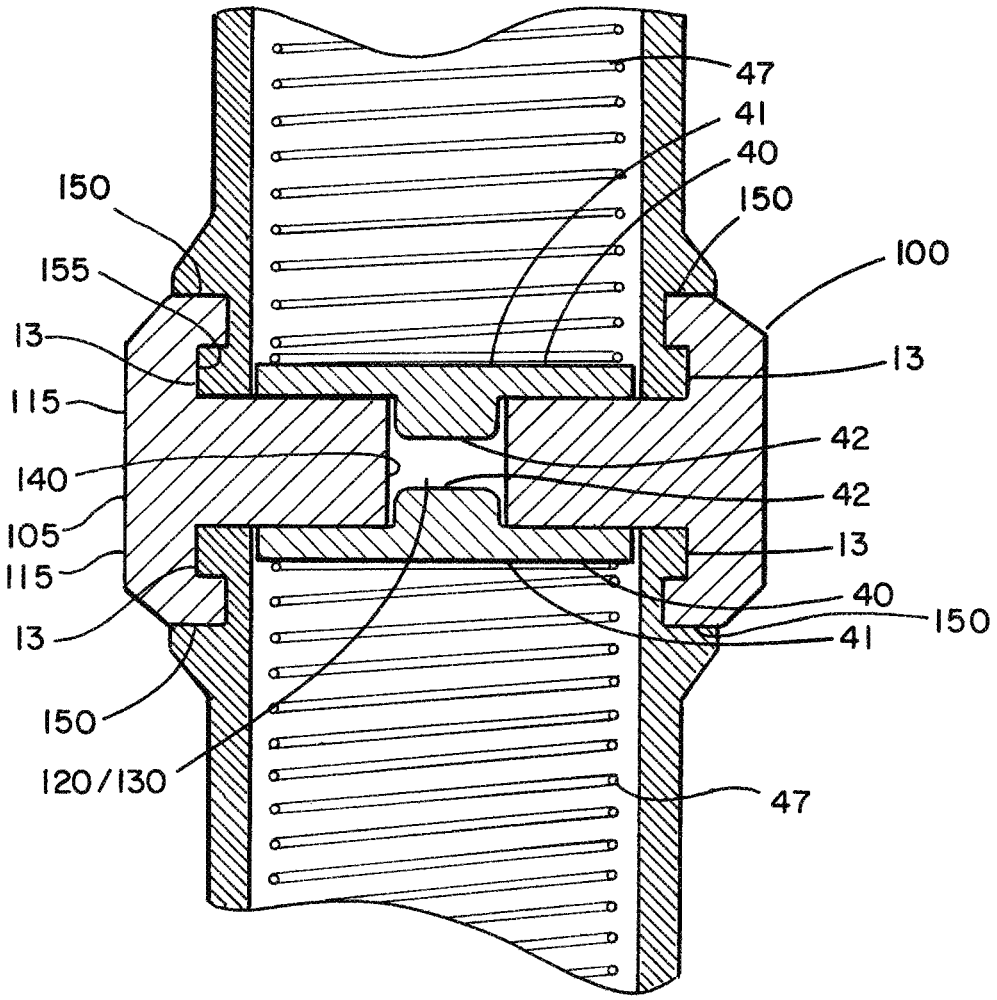
FIG. 8 is a partial cross-sectional view of the connected unit taken along line VIII-VIII in FIG. 2B.
Figure 9:
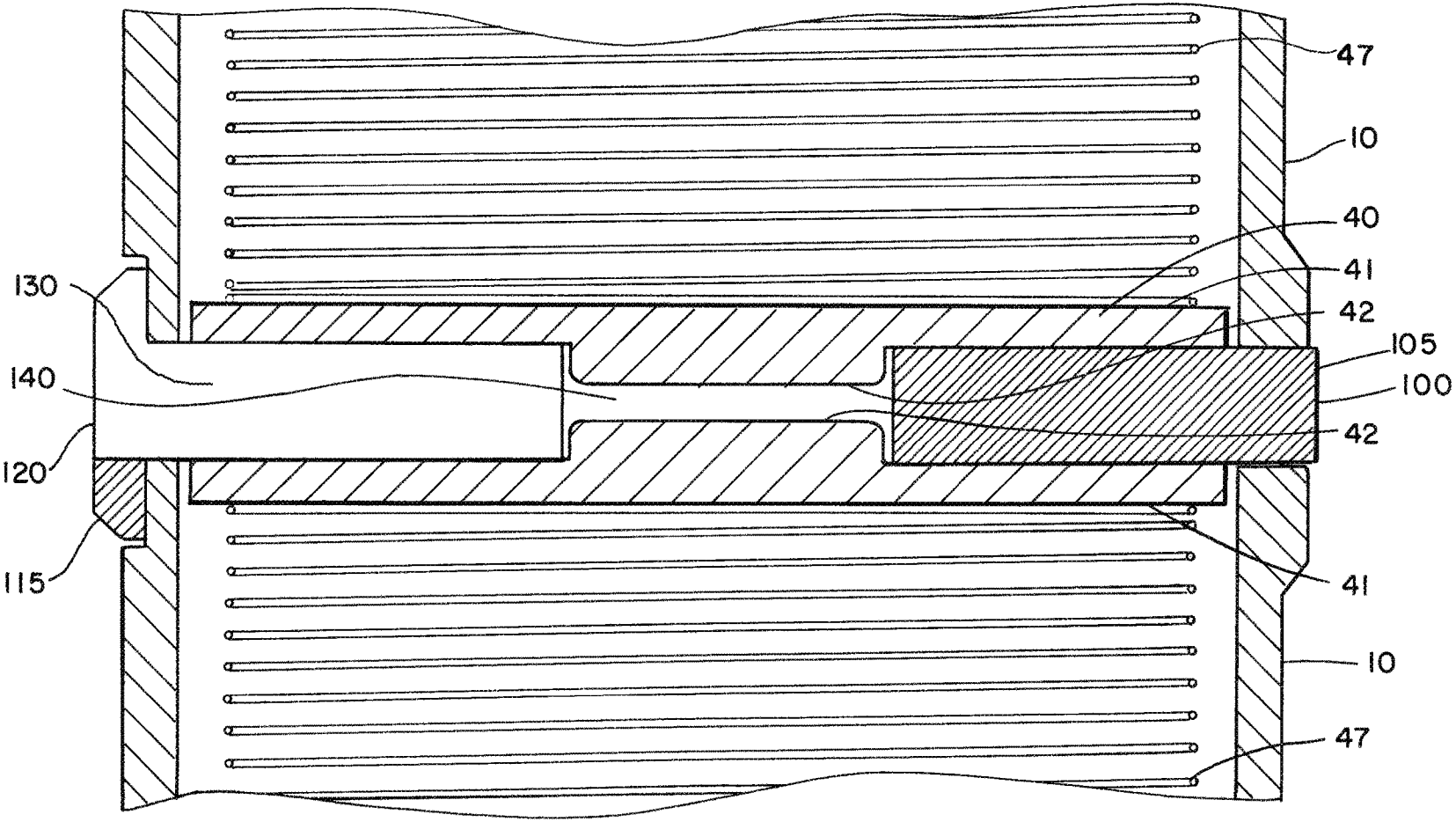
FIG. 9 is a partial cross-sectional view of the connected unit taken along line IX-IX in FIG. 2A.
Figure 10:
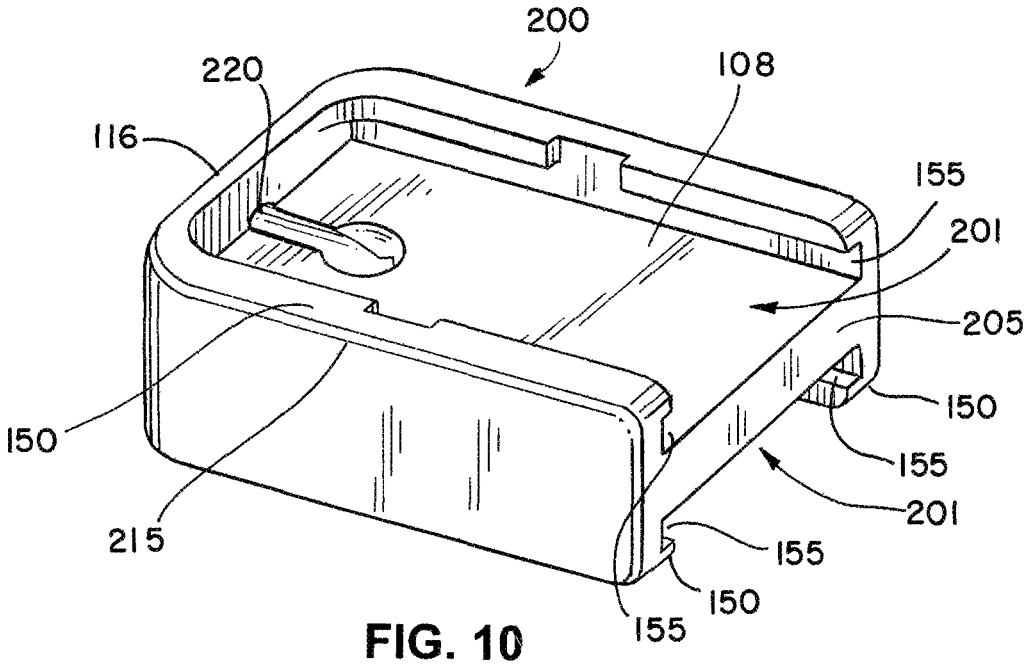
FIG. 10 is a top perspective view of another embodiment of the coupling device.
Figure 11:
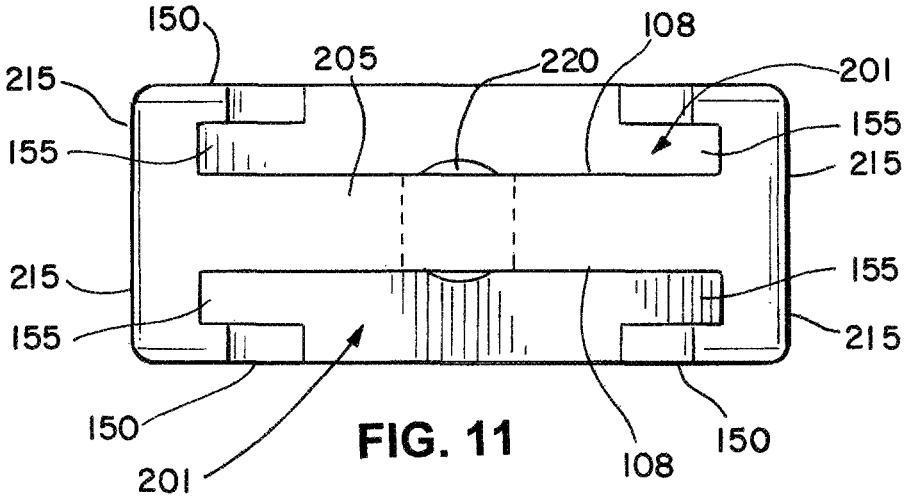
FIG. 11 is a front view of the coupling device of FIG. 10.
Figure 12:
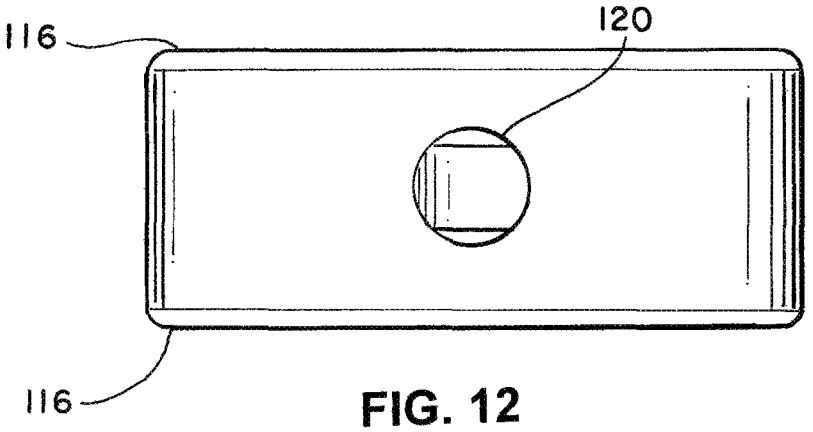
FIG. 12 is a rear view of the coupling device of FIG. 10.
Figure 13:
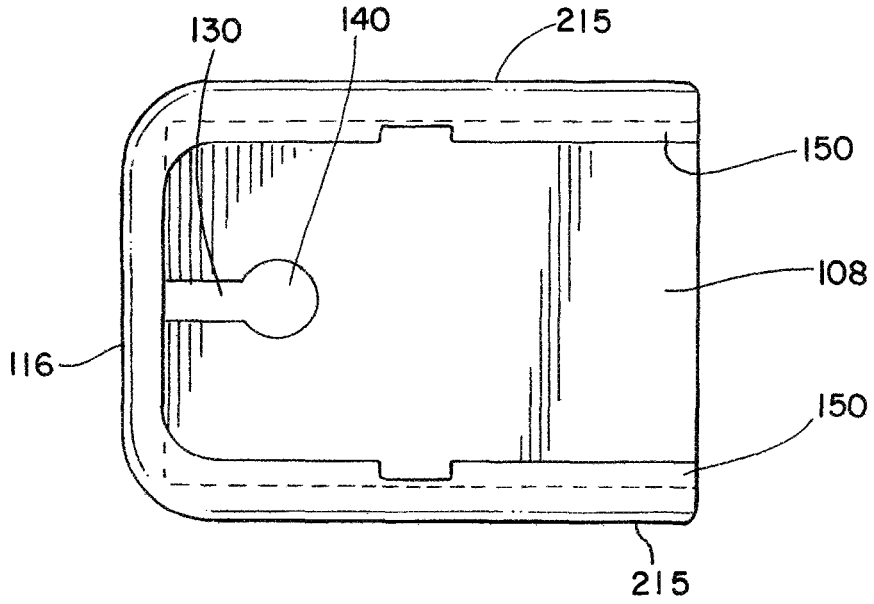
FIG. 13 is a top view of the coupling device of FIG. 10.

FIGS. 8 and 9 are cross-sections of the connected unit 20 which illustrate the tongue 13 and groove 155 joint and the release button 42 received inside the release button receptacle 140. The thickness of the base 105 determines the gap between the opposing release buttons 42 of the two connected magazines received in the release button receptacle 140. A tool (not shown), such as a screwdriver or the like, can be inserted through the access opening 120 and the release button access channel 130 to engage either or both release buttons 42. Specifically, the tool can be used to press one of the release buttons 42 out from the release button receptacle 140 while a user simultaneously slides the coupler 100 relative to the bottom end 12 of the magazine 10 to remove a first of the magazines 10 from the coupler 100. With one of the magazines 10 removed, the user can use the tool to directly press the other release button 42 out from the release button receptacle 140 to detach the second magazine 10 from the coupler 100. Alternatively, the tool can be inserted through the access opening 120.

Figure 14:
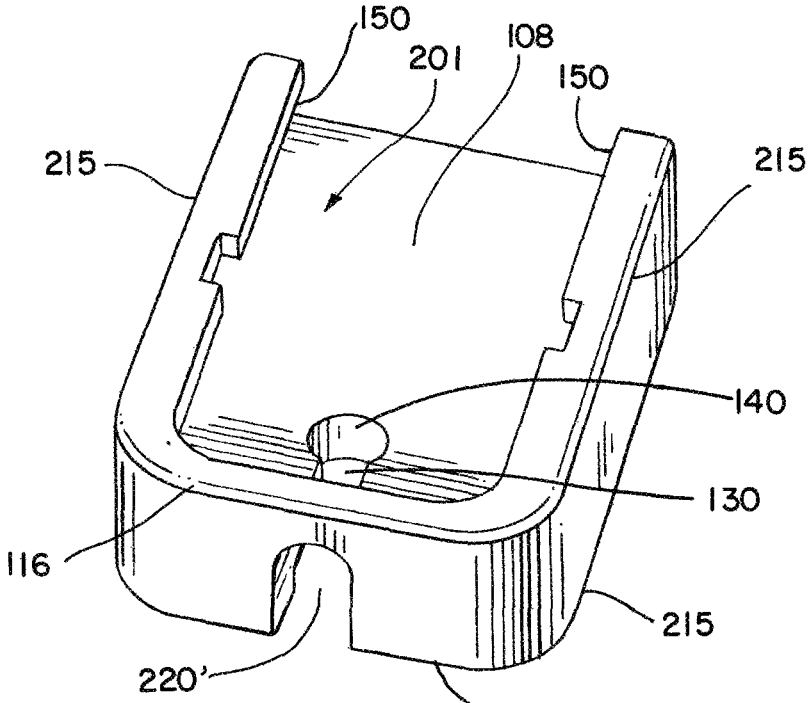
FIG. 14 is a top perspective view of another embodiment of the coupling device.

FIGS. 10-13 illustrate another embodiment of a coupler 200 similar to the coupler 100 in FIGS. 2-9, but having a different shape, with sidewalls 215 extending to the end of the coupler 200, and a circular access opening 220. In the illustrated embodiment, the coupler comprises a pair of floor plate structures 201 on opposite sides of a common hub or base 205. Alternatively, as shown in FIG. 14, the coupler 200 may have a U-shaped access opening 220'.

Figure 15:
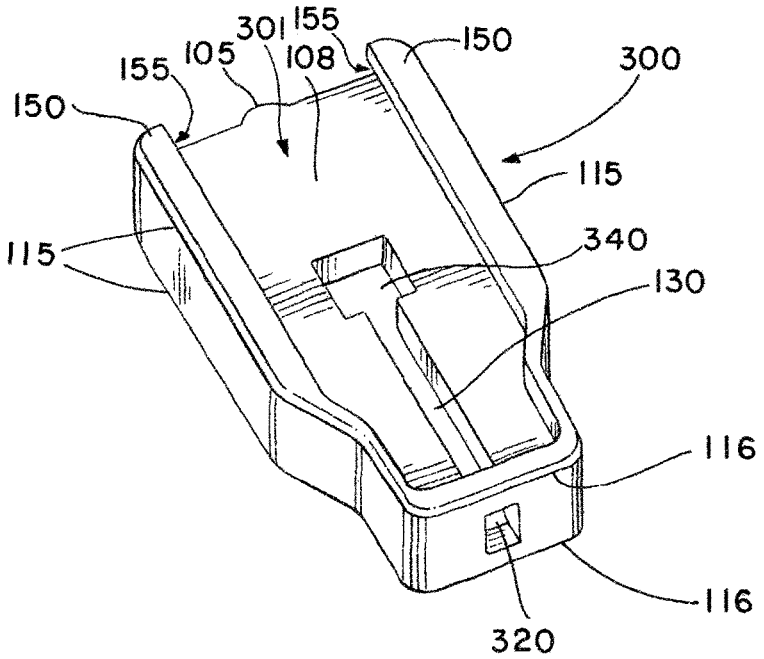
FIG. 15 is a top perspective view of yet another embodiment of the coupling device.

FIG. 15 shows yet another embodiment of a coupler 300 similar to the coupler 100 in FIGS. 2-9, but having a different shape, including specially shaped floor plate structures 301, a rectangular release button access hole 340, and a rectangular access opening 320.

Figure 16A:
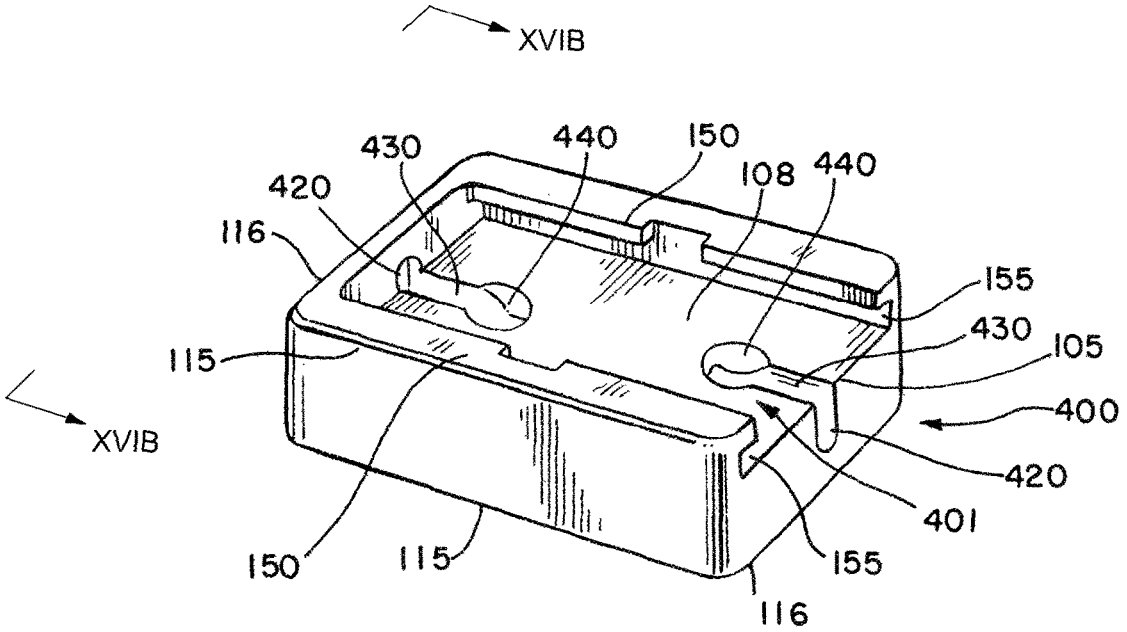
FIG. 16A is a top perspective view of still another embodiment of the coupling device.
Figure 16B:
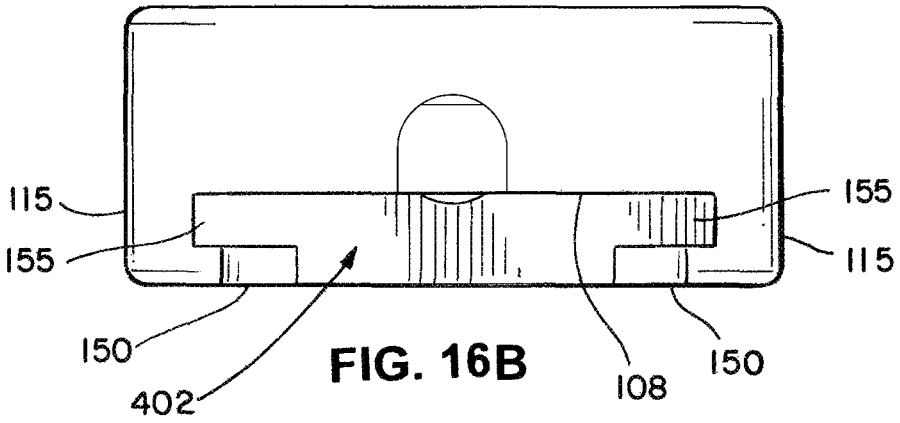
FIG. 16B is a rear view of the coupling device of FIG. 16A.

FIGS. 16A and 16B illustrate a further embodiment of a coupler 400 similar to the coupler 100 in FIGS. 2-9, but having a first floor plate structure 401 extending in a different direction from a second floor plate structure 402. Furthermore, there are two release button access holes 440 extending between the two floor plate structures 401, 402, each with a release button access channel 430 extending from the release button access hole 440 towards an opposite end of the coupler 400. This embodiment of the coupler 400 allows one magazine 10 to be oriented backwards. In some embodiments with only two floor plate structures 401, only one release button access channel 430 and access opening 420 may be provided, because the magazine 10 can be detached through the opposing floor plate structure 401 or 402 when one magazine 10 has been detached and removed.

Figure 17:
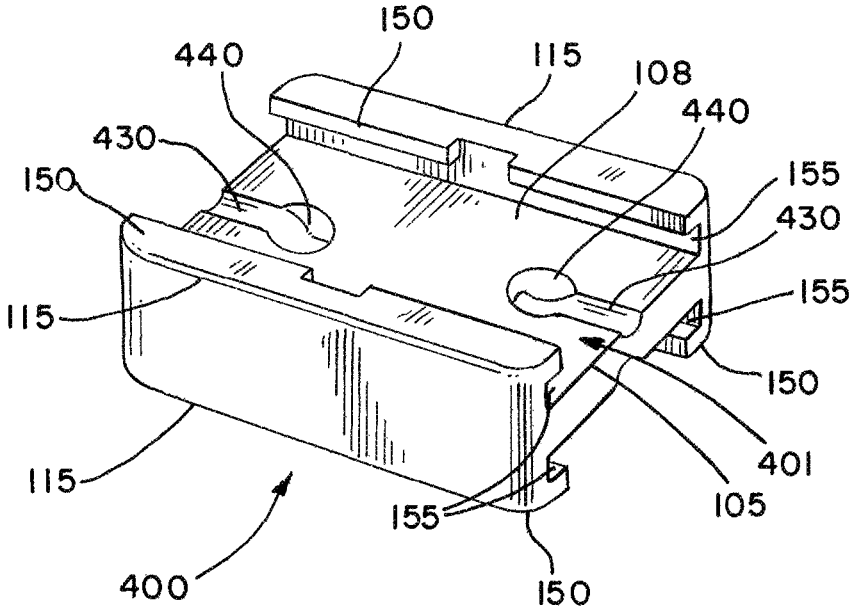
FIG. 17 is a top perspective view of a further embodiment of the coupling device.

In FIG. 17 a variant of the coupler 400 is shown, in which the coupler 400 does not have a back wall.

Although exemplary embodiments of the disclosure are illustrated and described herein, a number of variations and modifications will make themselves apparent to those skilled in the art. Such variations and modifications are understood as being encompassed within the spirit and scope of the disclosed subject matter, and all such changes and modifications are intended to be encompassed within the appended claims.

What is claimed is:

1. A magazine coupling device for connecting a plurality of detachable firearm magazines together, each of the magazines defining a chamber containing a magazine spring, each of the magazines having an open bottom end from which a magazine floorplate has been removed, the magazine coupling device comprising:

an insert configured to be installed in the open bottom end of each of the plurality of magazines, each of the inserts, when installed, being biased toward the open bottom end of the magazine in which the insert is installed by a biasing force applied by the magazine spring in the magazine in which the insert is installed, each of the inserts having a release button located so that when each of the inserts is installed in one of the plurality of magazines, the release button of each of the inserts extends toward the open bottom end of the one of the plurality of magazines;

a hub defining at least two floor plate structures, each of the floor plate structures being configured to be removably attached to the open bottom end of one of the plurality of magazines so as to retain the insert installed in the one of the plurality of magazines;

a release button receptacle defined in the hub, wherein the release button of each of the inserts retained by the floor plate structures is configured to be retained in the release button receptacle by the biasing force applied by one of the magazine springs; and a release button access channel extending from the release button receptacle to an access opening in the hub, wherein the access opening and the release button access channel are configured to allow the release button of each of the inserts to be engaged from outside the coupling device so as to urge the release button of each of the inserts out of the release button receptacle against the biasing force applied by the magazine spring in the one of the plurality of magazines in which each of the inserts is installed.

2. The magazine coupling device of claim 1, wherein each floor plate structure comprises:

a pair of main sidewalls extending from opposite edges of the base;

one or more nubs extending from an edge of the main sidewall; and one or more grooves cooperatively defined by the one or more nubs, the main sidewalls, and a surface of the base.

3. The magazine coupling device of claim 1, wherein the plurality of floor plate structures comprises an integral, unitary structure.

4. The magazine coupling device of claim 1, wherein each floor plate structure is oriented in the same direction.

5. The magazine coupling device of claim 1, wherein each floor plate structure is oriented in a different direction.

6. The magazine coupling device of claim 5, wherein the base has first and second ends, first and second release button receptacles, and first and second release button access channels respectively extending from the first and second ends of the base to the first and second release button receptacles.

7. The magazine coupling device of claim 1, wherein the base defines first and second floor plate structures arranged back-to-back.

8. The magazine coupling device of claim 1, wherein at least one of the floor plate structures is configured to provide a tongue-and-groove joint with the bottom end of one of the magazines.

* * * * *